US009499999B2

(12) United States Patent
Zhou

(10) Patent No.: US 9,499,999 B2
(45) Date of Patent: Nov. 22, 2016

(54) CAR ROOF TENT

(71) Applicant: Q-YIELD OUTDOOR GEAR LTD., Xiamen (CN)

(72) Inventor: Nanqing Zhou, Xiamen (CN)

(73) Assignee: Q-YIELD OUTDOOR GEAR LTD., Xiamen Fujian (CN)

( * ) Notice: Subject to any disclaimer, the term of this patent is extended or adjusted under 35 U.S.C. 154(b) by 0 days.

(21) Appl. No.: 14/895,485

(22) PCT Filed: Oct. 30, 2013

(86) PCT No.: PCT/CN2013/086239

§ 371 (c)(1),
(2) Date: Dec. 2, 2015

(87) PCT Pub. No.: WO2015/061991

PCT Pub. Date: May 7, 2015

(65) Prior Publication Data

US 2016/0138293 A1 May 19, 2016

(51) Int. Cl.

| | |
|---|---|
| ***E04H 15/06*** | (2006.01) |
| ***E04H 15/02*** | (2006.01) |
| ***E04H 15/48*** | (2006.01) |
| ***E04H 15/00*** | (2006.01) |

(52) U.S. Cl.

CPC ..... *E04H 15/06* (2013.01); *E04H 15/008* (2013.01); *E04H 15/02* (2013.01); *E04H 15/48* (2013.01)

(58) Field of Classification Search

CPC ..... E04H 15/06; E04H 15/008; E04H 15/02; E04H 15/48

USPC ..... 135/88.13, 88.14

See application file for complete search history.

(56) References Cited

U.S. PATENT DOCUMENTS

| | | | | | |
|---|---|---|---|---|---|
| 2,662,232 | A * | 12/1953 | Daly | B60P 3/38 | 135/119 |
| 3,009,471 | A * | 11/1961 | Rossiter | B60P 3/38 | 135/132 |
| 3,202,159 | A * | 8/1965 | Reed | B60P 3/38 | 135/120.2 |
| 3,375,836 | A * | 4/1968 | Domeneghetti | E04H 15/06 | 135/116 |
| 3,603,330 | A * | 9/1971 | Halldorson | B60P 3/38 | 135/116 |
| 3,924,365 | A * | 12/1975 | Orberg | B60P 3/38 | 135/116 |
| 4,058,133 | A * | 11/1977 | Barr | B60P 3/38 | 135/132 |
| 4,396,030 | A * | 8/1983 | Ferguson | E04H 15/06 | 135/88.17 |
| 4,522,441 | A * | 6/1985 | Allison | B60P 3/38 | 135/88.17 |
| 4,830,036 | A * | 5/1989 | Sanders | E04H 15/06 | 135/132 |
| 4,968,086 | A * | 11/1990 | Macisaac | E04H 15/06 | 135/88.16 |
| 5,544,671 | A * | 8/1996 | Phillips | B60P 3/341 | 135/150 |
| 9,222,278 | B2 * | 12/2015 | Park | E04H 15/06 | |
| 2010/0263698 | A1 * | 10/2010 | Chiu | E04H 15/06 | 135/88.17 |

* cited by examiner

*Primary Examiner* — Noah Chandler Hawk
(74) *Attorney, Agent, or Firm* — Leong C. Lei

(57) ABSTRACT

A car roof tent includes base, an expandable/collapsible tent frame, a rigid top cover, and a ladder. The tent frame is fixed to the base. The top cover is pivotally connected to the tent frame and is movable in unison with the tent frame so as to be set on and covering the tent after the collapse of the tent frame. The ladder has a top end pivotally connected to one side edge of the base and is upward rotatable to be positioned on the top cover. The rigid top cover is included and the ladder and the tent base are coupled such that the top cover and the ladder are movable with the operation of the tent frame. The operation is simple and the use is easy.

5 Claims, 9 Drawing Sheets

CAR ROOF TENT

(a) TECHNICAL FIELD OF THE INVENTION

The present invention relates generally to the technical field of tents, and more particularly to a car roof tent.

(b) DESCRIPTION OF THE PRIOR ART

The continuous increase of privately owned cars allows travels by self-driving a new way of enjoying trips. To suit the need of people for driving to travel by themselves, products attachable to cars to help people to make the self-driving trips and tents for cars have been developed for such a need.

A tent for cars may be structured for installation on the roof of a car. This makes the tent different from the regular camp tents by being set distant from the ground when it is set up so as to help prevent the invasion of moisture and cold air from the ground, making it more comfortable in use. Car roof tents are known, such as Chinese Patent CN201531147U, issued on Jul. 21, 2010; CN202187605U, issued on Apr. 11, 2012; and CN203213695U, issued Sep. 25, 2013.

The conventional car tent is generally made up of a base and a tent frame mounted on the base. The tent frame can be expanded or collapsed. A variety of structures are available for expanding and collapsing a tent frame, some being completely manually operated, some being semi-automatic devices that are operated with hand cranking, while the other allowing for fully automatic operations. However, for all these known structure, after the collapse of the tent, a cover must be provided to cover and shield the tent for aesthetics and dust-protecting purposes. For the known car roof tents, covers made of fabric are generally used. The operation requires a user to climb up to the car roof Such known structures and operation suffer the following disadvantages:

(1) The user needs to climb up to the car roof for the operation and thus, the operation is inconvenient.

(2) The fabric cover, although offering an effect of dust protection, is generally a soft structure that may readily have water accumulated thereon so as to increase the load of the car and allow water to penetrate therethrough, leading to a poor effect of water resistance.

(3) The fabric cover may not be easily washed and cleaned.

(4) The entire soft structure formed after the collapse of the car roof tent has a large wind resistance.

Further, since the tent is installed on the car roof, a ladder is needed for climbing up and down. Heretofore, the ladder is arranged independent and must be stowed inside the car when not in use and must also be removed from inside the car when used. This is inconvenient in use and occupies an internal space of the car.

SUMMARY OF THE INVENTION

The technical problem that the present invention is intended to address is to provide a car roof ten that is combined with a top cover and a ladder so that the operation is made easy and the structure is clean and practical.

To resolve the above technical problem, the present invention provides the following technical solution:

A car roof tent comprises a base, an expandable/collapsible tent frame, a rigid top cover, and a ladder. The tent frame is fixed on the base. The top cover is pivotally connected to the tent frame and is movable in unison with the tent frame to be set on and covering the tent after collapse of the tent frame. The ladder has a top end pivotally connected to a side edge of the base and is upward rotatable to be positioned on the top cover.

The top cover has a top surface in which an accommodation trough is formed and the ladder, after being rotated upward, is receivable into and positionable in the accommodation trough.

The base comprises a connection member mounted thereto and extending outward therefrom by a predetermined distance. The top end of the ladder is pivotally connected to an outward-extending end of the connection member. The ladder comprises a right-angle joint provided at a center thereof for pivotal connection between segments thereof so as to allow the ladder to be folded in a bisecting manner.

The top cover has a top surface in which a flow guide groove is formed.

The tent frame comprises at least two support bar assemblies. The two support bar assemblies are mounted to two sides of the base and parallel to each other and each comprising a support bar, an upper support bar, and a lower support bar that are pivotally connected in sequence. The support bar and the lower support bar are pivotally connected to the base. The base, the support bar, and a combination of the upper support bar and the lower support bar collectively define a triangular configuration when expanded. The top cover has one side pivotally connected to the pivotal connection between the support bar and the upper support bar.

The top cover has a bottom pivotally connected to at least one top cover brace bar. The top cover brace bar has an opposite distal end pivotally connected to a slide member. The slide member is slidably mounted to the support bar.

The slide member and the support bar comprise a fixing structure arranged therebetween to selectively fix the slide member on the support bar.

With the above-discussed solution, the present invention provide the following advantages:

(1) The present invention comprises a rigid top cover mounted on a car roof tent and the top cover is movable in unison with the tent frame. Further, a ladder is pivotally connected to the base of the tent and the ladder is upward rotatable to be positioned on the top cover so that when the tent frame is operated, the top cover and the ladder are moved with the operation of the tent frame, making the operation simple and the utilization practical.

(2) The rigid top cover helps protect against dust and prevents accumulation of water thereon and also provides a bettered effect of water resistance.

(3) The rigid top cover can be washed with the car so that washing and cleaning is convenient and easy.

(4) Since the top cover is rigid and thus does not move with wind like a soft cover so that the wind resistance is reduced.

(5) The ladder is positioned, together with the car roof tent, on the car roof without occupying an internal space of the car and is movable with the top cover, making the use easy and convenient.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
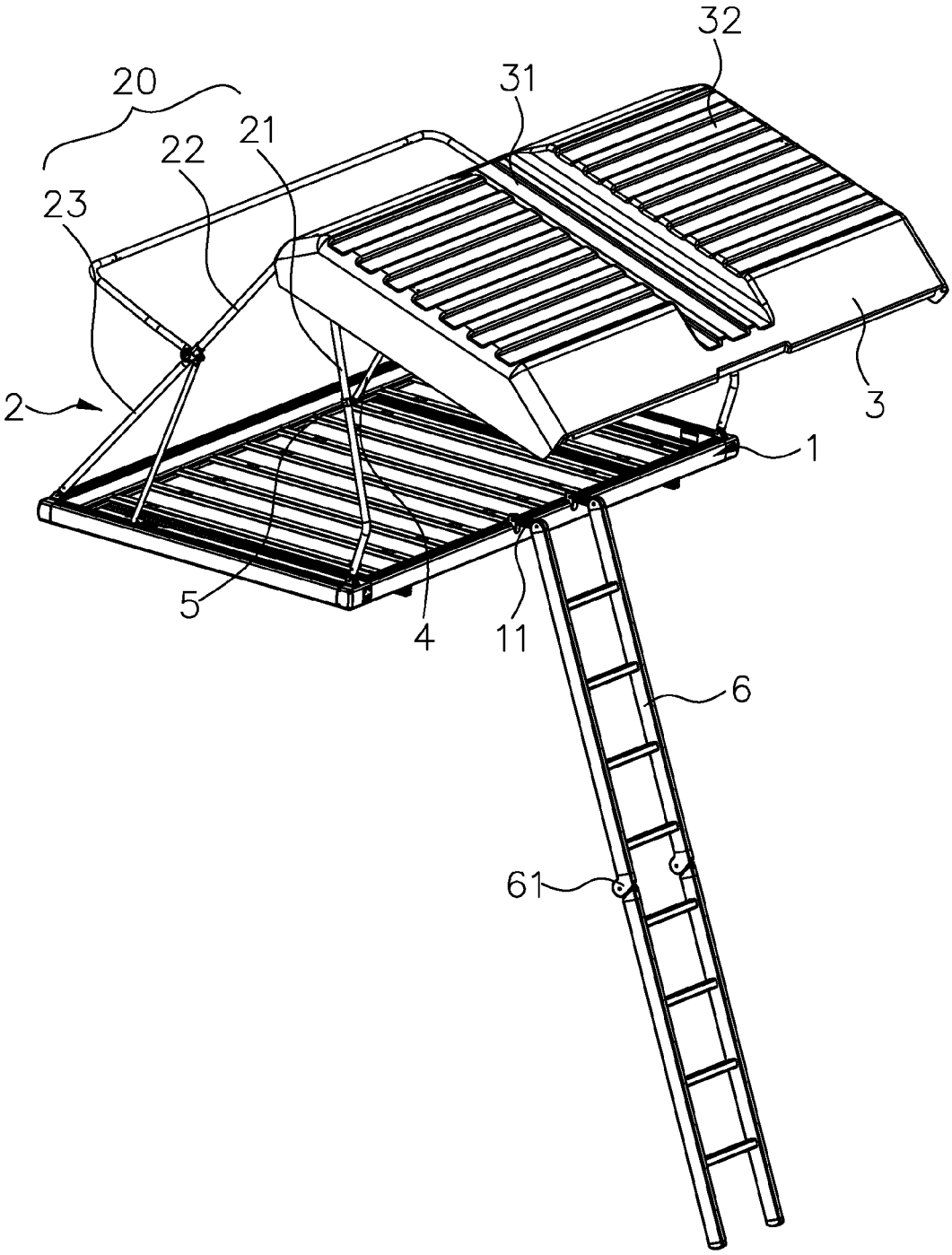
FIG. 1 is a schematic view illustrating the structure of the present invention.
Figure 2:
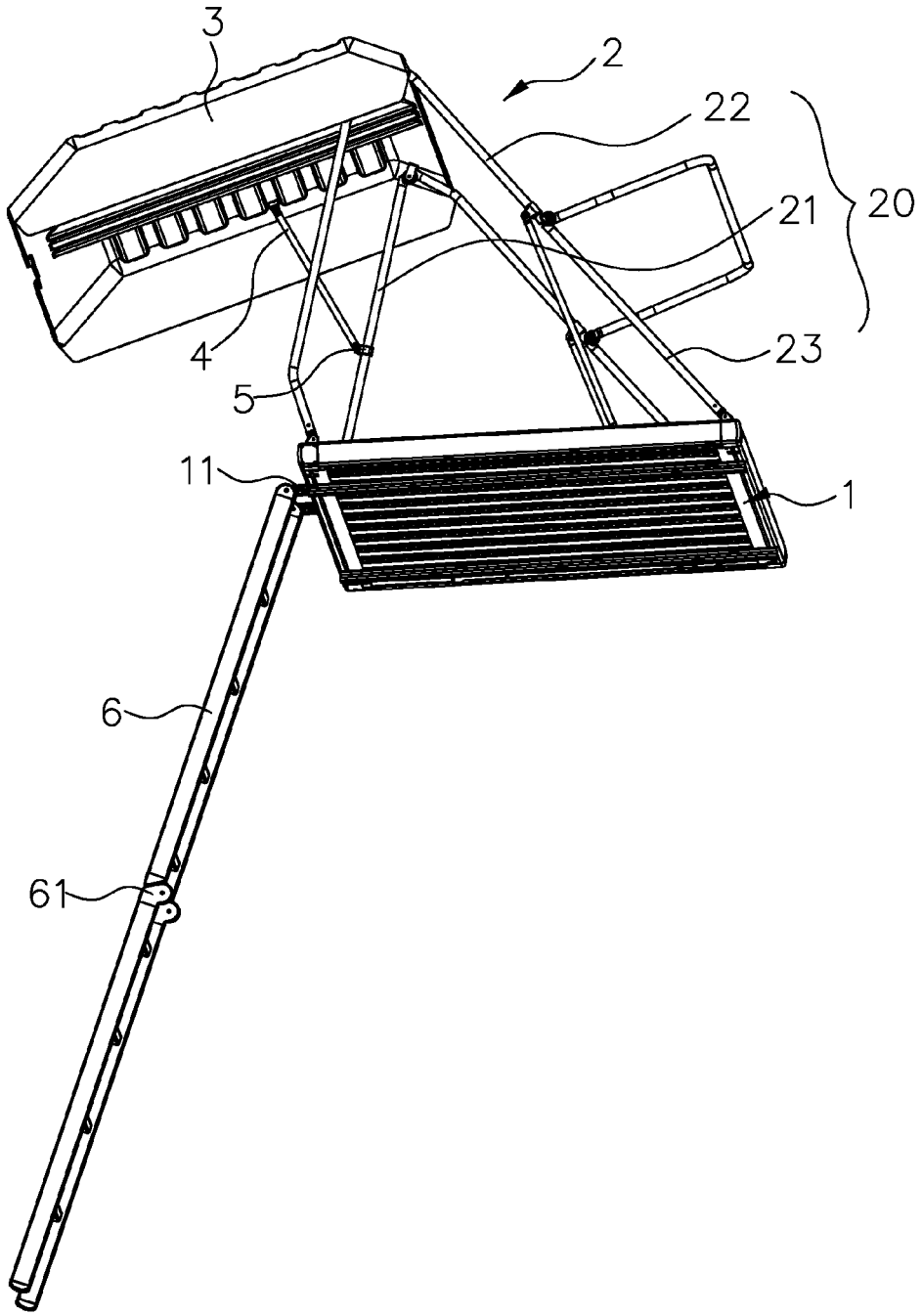
FIG. 2 is another schematic view illustrating the structure of the present invention.
Figure 3:
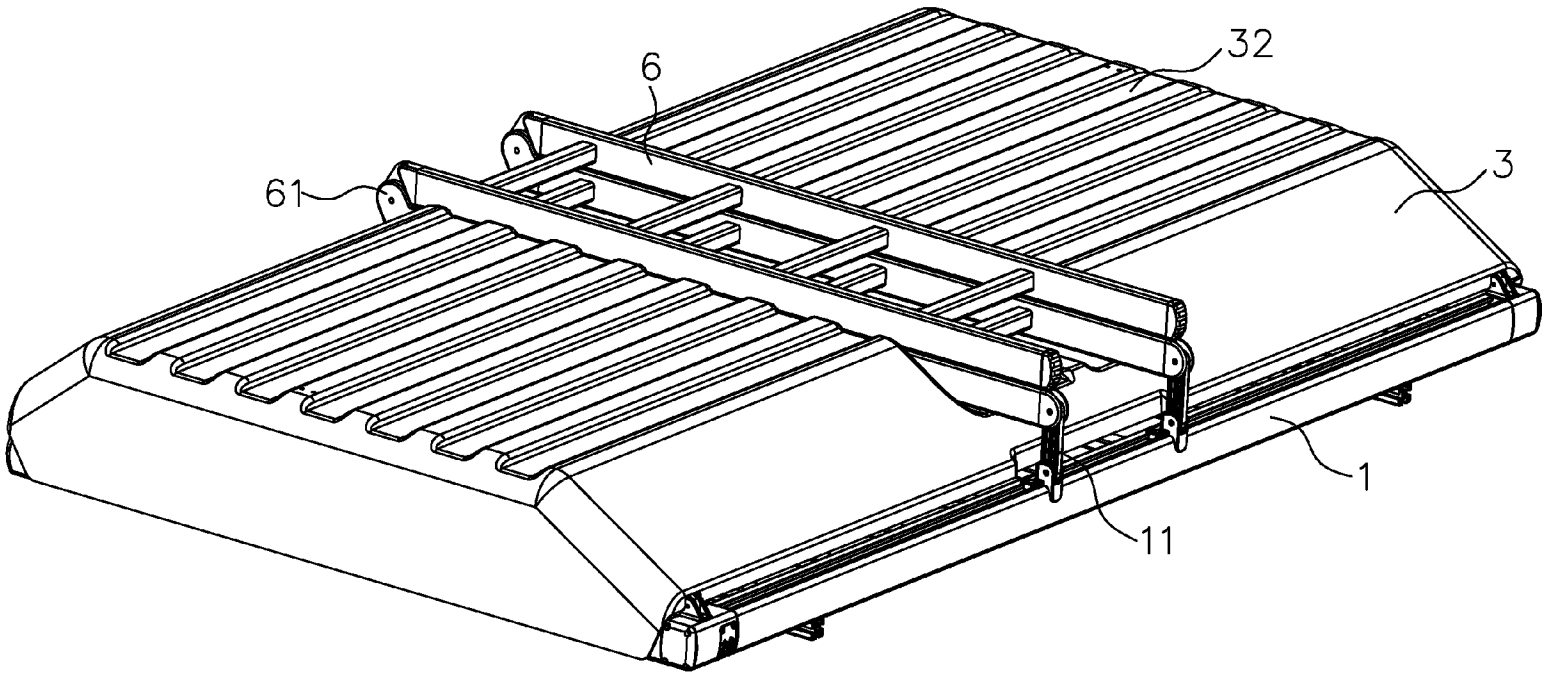
FIG. 3 is a schematic view illustrating the present invention in a collapsed condition.

The present invention discloses a car roof tent, and as shown in FIGS. 1-3, a preferred embodiment of the present invention is illustrated. The car roof tent comprises a base 1, an expandable/collapsible tent frame 2, a rigid top cover 3, and a ladder 6.

The tent frame 2 is mounted to the base 1. The tent frame 2 may have a specific structure that is any one of the three Chinese patents discussed previously in the section of "Description of the Prior Art" and any other structures that allow for expansion and collapse.

The top cover 3 is pivotally connected to the tent frame 2 so as to be movable in unison with the tent frame 2.

The ladder 6 has a top end pivotally connected to a side edge of the base 1 and is upward lifted and rotated to be positioned on the top cover 3.

Further, an accommodation trough 31 may be formed in a top surface of the top cover 3 so that the ladder 6, after being upward rotated, is received into and positioned in the accommodation trough 31.

Further, flow guide grooves 32 may be formed in the top surface of the top cover 3 to conduct and guide rainwater in order to prevent accumulation of water.

As shown in FIG. 3, in use of the car roof tent, the top cover 3 is moved with the operation of the tent frame 2 so as to be set on and outside the tent when the tent frame 2 is collapsed to provide an effect of protection of the tent or for dust protection. The ladder 6 is coupled to the tent so as to be upward rotated above and positioned on the top cover 3 when the tent is collapsed and to be received and held in the accommodation trough 31 of the top cover 3, making the convenient.

Further, in the instant embodiment, the tent frame 2 comprises at least two sets of support bar assembly 20 and the two sets of support bar assembly 20 are mounted, in a manner of being parallel to each other, to two sides of the base 1 and each comprises a support bar 21, an upper support bar 22, and a lower support bar 23 that are pivotally connected in sequence. The support bar 21 and the lower support bar 23 are also pivotally connected to the base 1. Further, when expanded, the base 1, the support bar 21, and a combination of the upper support bar 22 and the lower support bar 23 collectively define a triangular configuration. When the upper and lower support bars 22, 23 are folded with respect to each other, the support bar 21 is caused to move toward the base 1 so as to collapse the tent frame 2. The operation of the support bar 21 and the upper and lower support bars 22, 23 can be done manually or can be controlled with an external structure or device to achieve manual, semi-automatic, or fully-automatic operation, this being not a novel part of the present invention so that details thereof will be omitted herein. The top cover 3 is pivotally connected, with one side thereof, to a pivotal connection between the support bar 21 and the upper support bar 22. The top cover 3 is further pivotally connected, with a bottom surface thereof, to at least one top cover brace bar 4. The top cover brace bar 4 has an opposite distal end that is pivotally connected to a slide member 5. The slide member 5 is slidably mounted to the support bar 21. As such, after the erection and expansion of the tent, the top cover 3 is lifted and supported high to serve as a shed. To have the top cover 3 stably held and fixed after expanded, a fixing structure (not shown) may be provided between the slide member 3 and the support bar 21 and such a fixing structure functions to securely fix the position of the slide member 3 on and with respect to the support bar 21. Such a fixing structure may be one that is commonly known in the field of tent for use between a bar and a slide. For example, a spring-biased projection may be arranged in a hollow bar in such a way that the spring-biased projection partly projects outside the bar to engage a hole formed in a slide so as to securely constrain the slide on the bar.

Figure 4:
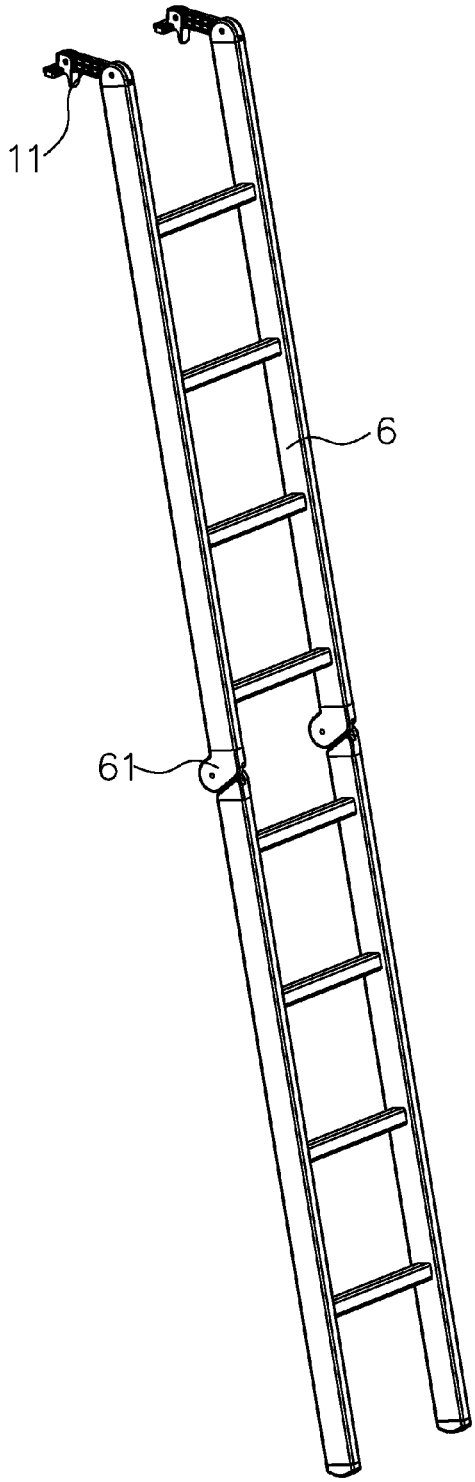
FIG. 4 is a schematic view illustrating a ladder of the present invention in an expanded condition.
Figure 5:
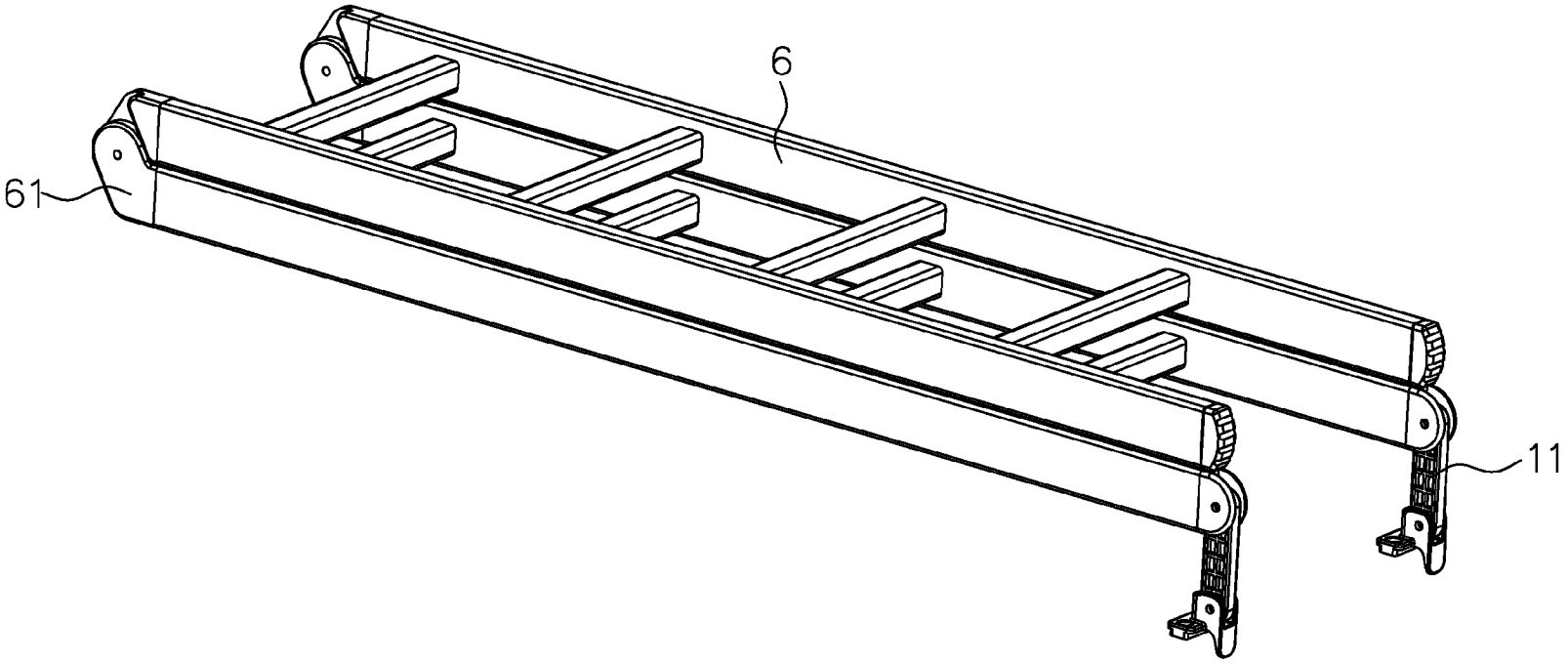
FIG. 5 is a schematic view illustrating the ladder of the present invention in a collapsed condition.
Figure 6:
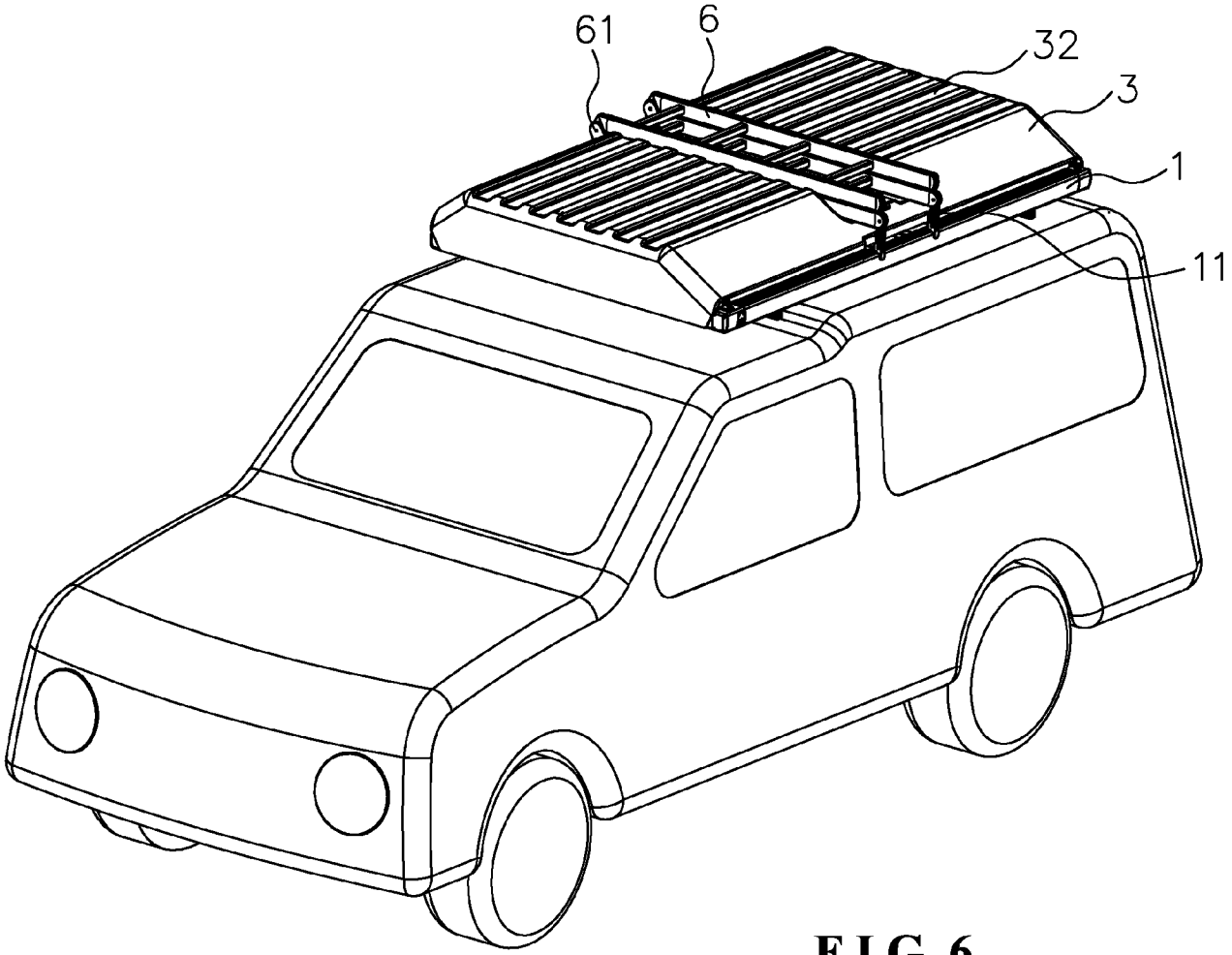
FIG. 6 is a schematic view illustrating the present invention installed on a car roof in a collapsed condition.
Figure 7:
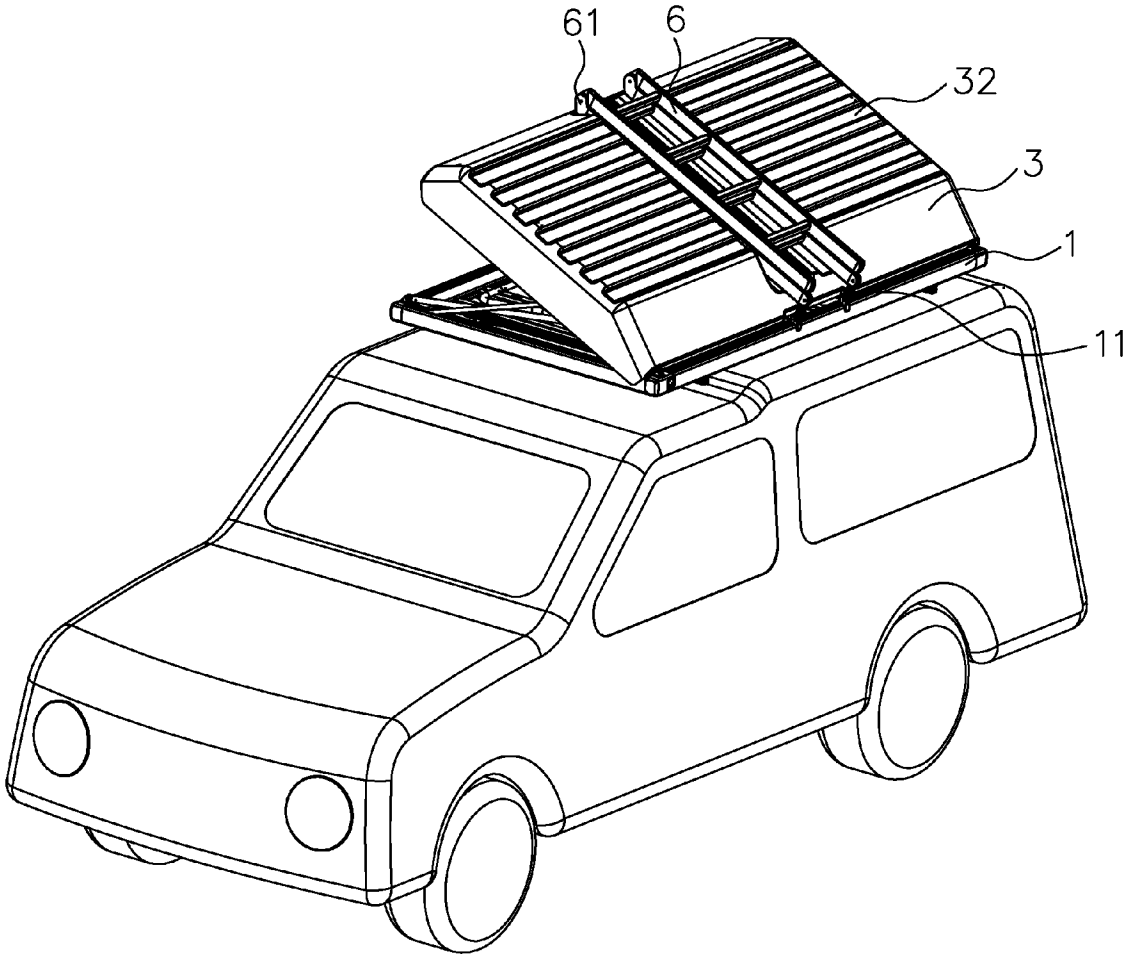
FIG. 7 is a schematic view illustrating a process of expanding the present invention that is installed on the car roof.

Referring also to FIGS. 4 and 5, to allow the ladder 6 to be rotated upward smoothly, the base 1 may comprise a connection member 11 mounted thereto and extending outward for a predetermined distance. The ladder 6 is pivotally connected, with a top end thereof, to an outward-extending end of the connection member 11. Further, a right-angle joint 61 may be provided at and between segments of the ladder 6 for pivotal connection therebetween so that the ladder 6 has a center-foldable bisecting structure to reduce the length of the ladder, making it easy and convenient to stow in the accommodation trough 31 of the top cover 3.

Figure 8:
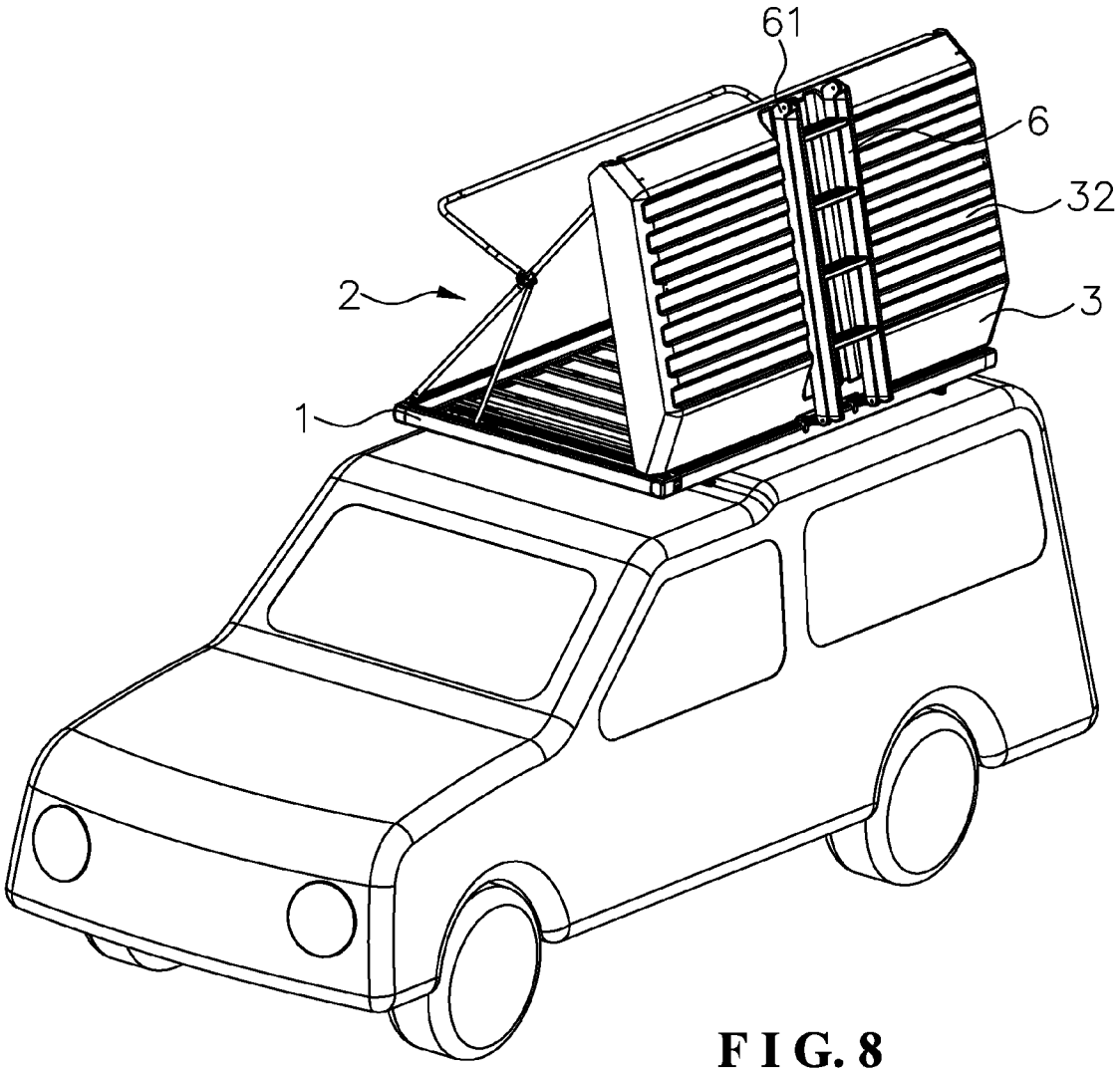
FIG. 8 is another schematic view illustrating the process of expanding the present invention that is installed on the car roof.
Figure 9:
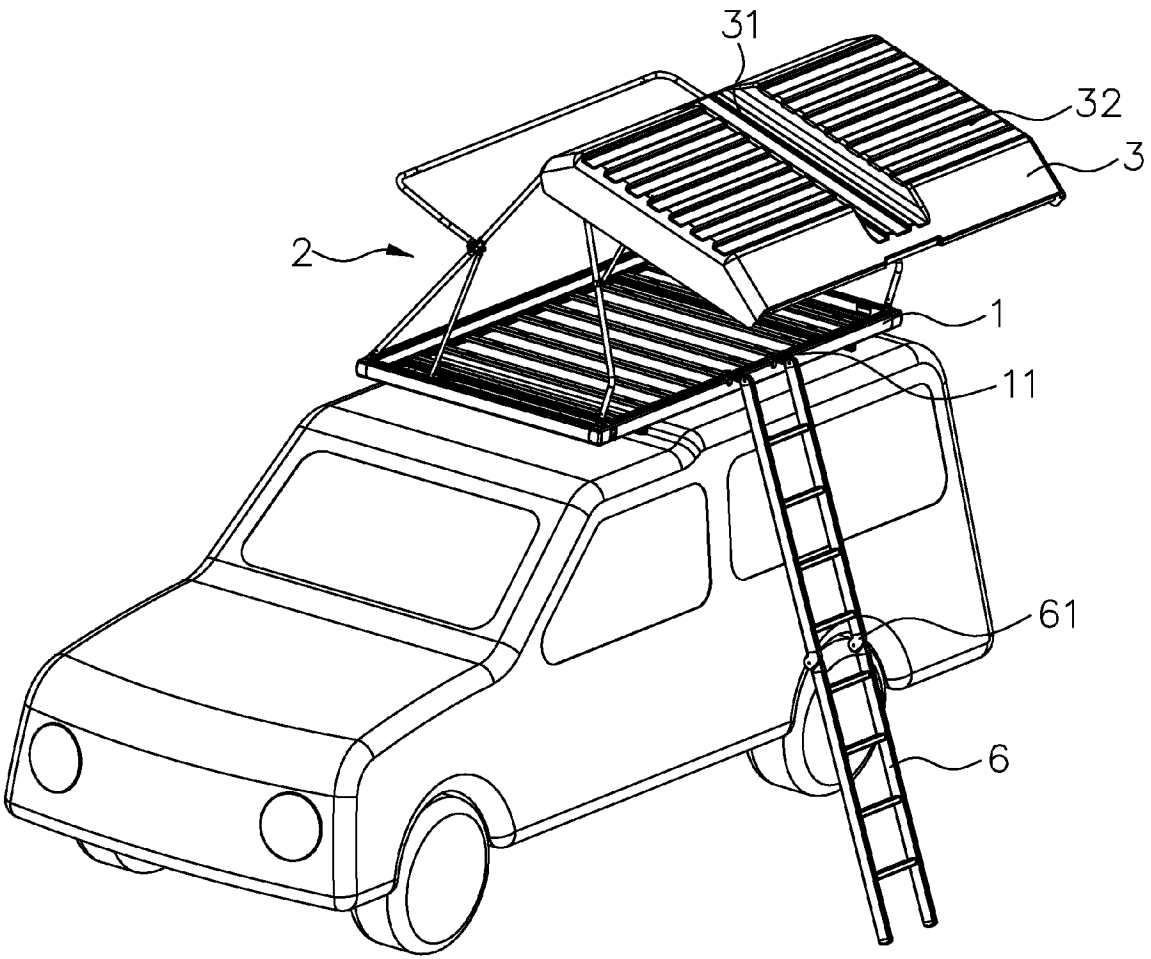
FIG. 9 is a schematic view illustrating the present invention installed on the car roof in an expanded condition.

As shown in FIGS. 6-9, schematic views are given to illustrate the condition when the car roof tent of the present invention is installed on a roof of a car. When the tent frame 2 is being expanded, the top cover 3 is moved in unison therewith. And, after the expansion of the tent frame 2 (as shown in FIG. 8), the top cover 3 is leant against one side of the tent frame 2. During this process, the ladder 6 is also moved with the top cover 3. Afterwards, the ladder 6 is rotated downward to be positioned on the ground. Then, the top cover 3 is lifted upward for opening and expansion and during the opening process, the distal end of the top cover brace bar 4 pulls the slide member 5 to have the slide member 5 slide upward along the support bar 21 until the top cover 3 is completely opened and expanded, where the top cover brace bar 4 provides an effect of supporting and fixing the top cover 3 and the top cover 3 so supported may serve as a shed. To collapse, operation is conducted in opposite sequence and direction.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A car roof tent, comprising a base and an expandable/collapsible tent frame, the tent frame being fixed to the base, and further comprising a rigid top cover and a ladder, the top cover being pivotally connected to the tent frame and movable in unison with the tent frame to be set on and covering the tent after collapse of the tent frame, the ladder having a top end pivotally connected to a side edge of the base and upward rotatable to be positioned on the top cover;

wherein the tent frame comprises at least two support bar assemblies, the two support bar assemblies being mounted to two sides of the base and parallel to each other, each comprising a support bar, an upper support bar, and a lower support bar that are pivotally connected in sequence, the support bar and the lower support bar being pivotally connected to the base, the base, the support bar, and a combination of the upper support bar and the lower support bar collectively defining a triangular configuration when expanded, the top cover having one side pivotally connected to the pivotal connection between the support bar and the upper support bar, the top cover having a bottom pivotally connected to at least one top cover brace bar, the top cover brace bar having an opposite distal end pivotally connected to a slide member, the slide member being slidably mounted to the support bar.

2. The car roof tent according to claim 1, wherein the top cover has a top surface in which an accommodation trough is formed and the ladder, after being rotated upward, is receivable into and positionable in the accommodation trough.

3. The car roof tent according to claim 2, wherein the base comprises a connection member mounted thereto and extending outward therefrom by a predetermined distance, the top end of the ladder being pivotally connected to an outward-extending end of the connection member, the ladder comprising a right-angle joint provided at a center thereof for pivotal connection between segments thereof so as to allow the ladder to be folded in a bisecting manner.

4. The car roof tent according to claim 1, wherein the top cover has a top surface in which a flow guide groove is formed.

5. The car roof tent according to claim 1, wherein the slide member and the support bar comprise a fixing structure arranged therebetween to selectively fix the slide member on the support bar.

* * * * *